US005588271A

United States Patent [19]

Pitchford

[11] Patent Number: 5,588,271

[45] Date of Patent: Dec. 31, 1996

[54] INTERLOCKING BUILDING BLOCK

[76] Inventor: Peter R. Pitchford, 170 Ellis Park Road, Toronto, Ontario, Canada, M6S 2V6

[21] Appl. No.: 122,485

[22] PCT Filed: Jan. 29, 1993

[86] PCT No.: PCT/CA93/00038

§ 371 Date: Sep. 29, 1993

§ 102(e) Date: Sep. 29, 1993

[87] PCT Pub. No.: WO93/15286

PCT Pub. Date: Aug. 5, 1993

[30] Foreign Application Priority Data

Jan. 30, 1992 [CA] Canada ..... 2060379-8

[51] Int. Cl.[6] ..... E04C 1/00; E04B 2/00

[52] U.S. Cl. ..... 52/306; 52/592.2; 52/592.3; 52/792.1; 52/795.1

[58] Field of Search ..... 52/306, 307, 308, 52/788, 802, 805, 810, 569, 570, 571, 572, 580, 592.1, 592.2, 592.3, 592.4, 592.5, 592.6

[56] References Cited

U.S. PATENT DOCUMENTS

| | | | |
|---|---|---|---|
| 1,719,620 | 7/1929 | Oesterla . | |
| 3,252,260 | 5/1966 | Mills | 52/805 |
| 3,286,423 | 11/1966 | Donlon | 52/780 |
| 3,351,958 | 11/1967 | Shields | 52/300 |
| 3,798,861 | 3/1974 | Weiss . | |
| 3,886,709 | 6/1975 | Krah et al. | 52/396.07 |
| 3,971,075 | 7/1976 | Heinbaugh et al. | 52/396.07 |
| 4,083,158 | 4/1978 | Wolma | 52/300 |
| 4,648,226 | 3/1987 | Manon . | |
| 5,031,372 | 7/1991 | McCluer | 52/308 |
| 5,042,210 | 8/1991 | Taylor | 52/307 |

FOREIGN PATENT DOCUMENTS

| | | | |
|---|---|---|---|
| 920764 | 2/1973 | Canada . | |
| 0368479 | 5/1990 | European Pat. Off. . | |
| 0438110 | 7/1991 | European Pat. Off. . | |
| 0452879 | 10/1991 | European Pat. Off. . | |
| 1401279 | 4/1965 | France . | |
| 1609852 | 10/1969 | Germany . | |
| 2307952 | 8/1974 | Germany . | |
| 2552622 | 5/1977 | Germany . | |
| 269730 | 12/1929 | Italy . | |
| 651601 | 4/1951 | United Kingdom . | |
| 2210079 | 6/1989 | United Kingdom | 52/396.07 |

*Primary Examiner*—Michael Safavi
*Attorney, Agent, or Firm*—Barrigar & Moss

[57] ABSTRACT

An interlocking building block is disclosed primarily as a replacement for glass blocks or tiles. The block has front and rear walls or surfaces and intermediate peripheral end walls that intersect at an angle. At least two intersecting end walls have tongues and grooves adapted to mate with corresponding grooves and tongues on adjacent blocks and these tongues and grooves on the intersecting end walls each have interlocking means to engage complimentary interlocking means on adjacent blocks to prevent sliding movement therebetween, thus giving a four-direction interlock between the blocks.

7 Claims, 13 Drawing Sheets

INTERLOCKING BUILDING BLOCK

TECHNICAL FIELD

This invention relates to interlocking building blocks and to the construction of walls employing same, and in particular to blocks with multi-directional interlocking capabilities.

BACKGROUND ART

This invention is directed primarily to glass block or tile wall construction wherein walls are formed from transparent or translucent hollow glass blocks. In such walls, the blocks are arranged in rows and columns to form a wall, and the blocks are typically joined together using mortar. A difficulty with these blocks and this type of wall construction, however, is that the blocks are quite heavy, and unless elaborate and complicated spacing devices are used, it is only possible to construct a few rows of blocks at a time, because the mortar has to set on the lower rows before it will bear the weight of additional rows formed on top of them. There is also a problem of the alignment of the glass blocks. It usually takes a skilled mason to produce a good looking wall with a smooth surface, evenly spaced blocks and uniform mortar joints.

In order to overcome some of these limitations, it has been proposed to produce blocks formed of transparent or translucent plastic, such as acrylic. The lightweight of the plastic overcomes the weight problem of glass blocks, so that the plastic block walls can be made pretty much to any height desired. However, there is still the problem of the alignment of the blocks, and prior art plastic block walls have been known to be lacking in strength or durability as compared to a well made glass block wall.

Several attempts have been made to address the alignment problem. One example is shown in U.S. Pat. No. 4,648,226 issued to Gerard Manon. This patent shows a glass block having a tongue and groove edge formation. While this would appear to solve the lateral misalignment problem, there is no solution to the longitudinal, or horizontal and vertical misalignment problem, and this Manon block also has a strength problem, since it would appear that the only place for mortar is in the grooves, the depth of the grooves being greater than the width of the ribs or tongues to provide space for the mortar.

U.S. Pat. No. 1,719,620 issued to A. C. Oesterla shows another tongue and groove type construction. This construction also addresses the lateral alignment problem, subject to variations caused by mortar thickness. In addition, horizontal misalignment is taken care of by means of vertical lugs or projections that fit into notches in lower blocks. There is no mechanism, however, to take care of vertical misalignment.

U.S. Pat. No. 3,286,423 shows a block somewhat similar to Manon with the added feature of a connecting device to prevent the horizontal separation of the vertical block walls. While this does not add anything to the alignment of the blocks, it does increase the strength of a wall made from these blocks by preventing horizontal separation of the blocks.

DISCLOSURE OF INVENTION

In the present invention, a lightweight block is provided with multi-directional interlocking for vertical, horizontal and lateral block alignment.

According to one aspect of the invention, there is provided an interlocking building block comprising a block having spaced-apart front and rear walls and peripheral end walls. The block is shaped such that a plurality of such blocks may be arranged in a contiguous manner with respective end walls touching to form a wall. There are at least two adjacent peripheral end walls on each block intersecting at an angle. Each of the intersecting end walls has an elongate rib and a parallel elongate groove spaced therefrom and adapted to mate with a corresponding respective elongate groove and rib on an adjacent block. A first interlocking means is formed on one of the intersecting end walls adapted to engage a complimentary interlocking means on a first adjacent block to prevent sliding movement relative to the first adjacent block. Also, a second interlocking means is formed on the other of the intersecting end walls adapted to engage a complimentary interlocking means on a second adjacent block to prevent sliding movement relative to the second adjacent block.

According to another aspect of the invention, there is provided a block wall comprising a plurality of blocks as set forth above, the blocks being arranged with each of the two intersecting end walls on a first block being in contact with a respective intersecting end wall on an adjacent block, and the interlocking means on the first block intersecting end walls engaging respective interlocking means on the adjacent block end walls.

According to yet another aspect of the invention, there is provided a block wall comprising a pair of blocks as set forth above, the blocks being spaced apart with an intersecting end wall on one block facing an intersecting end wall on the second block. A hinge clip joins the respective facing end walls. The hinge clip has a central resilient member with transversely disposed spaced-apart side flanges that engage and hold together lateral projections formed on outwardly disposed ribs which form part of the interlocking means between the blocks.

BRIEF DESCRIPTION OF THE DRAWINGS

Preferred embodiments of the invention will now be described, by way of example, with reference to the accompanying drawings, in which.

BEST MODE FOR CARRYING OUT THE INVENTION

Figure 1:
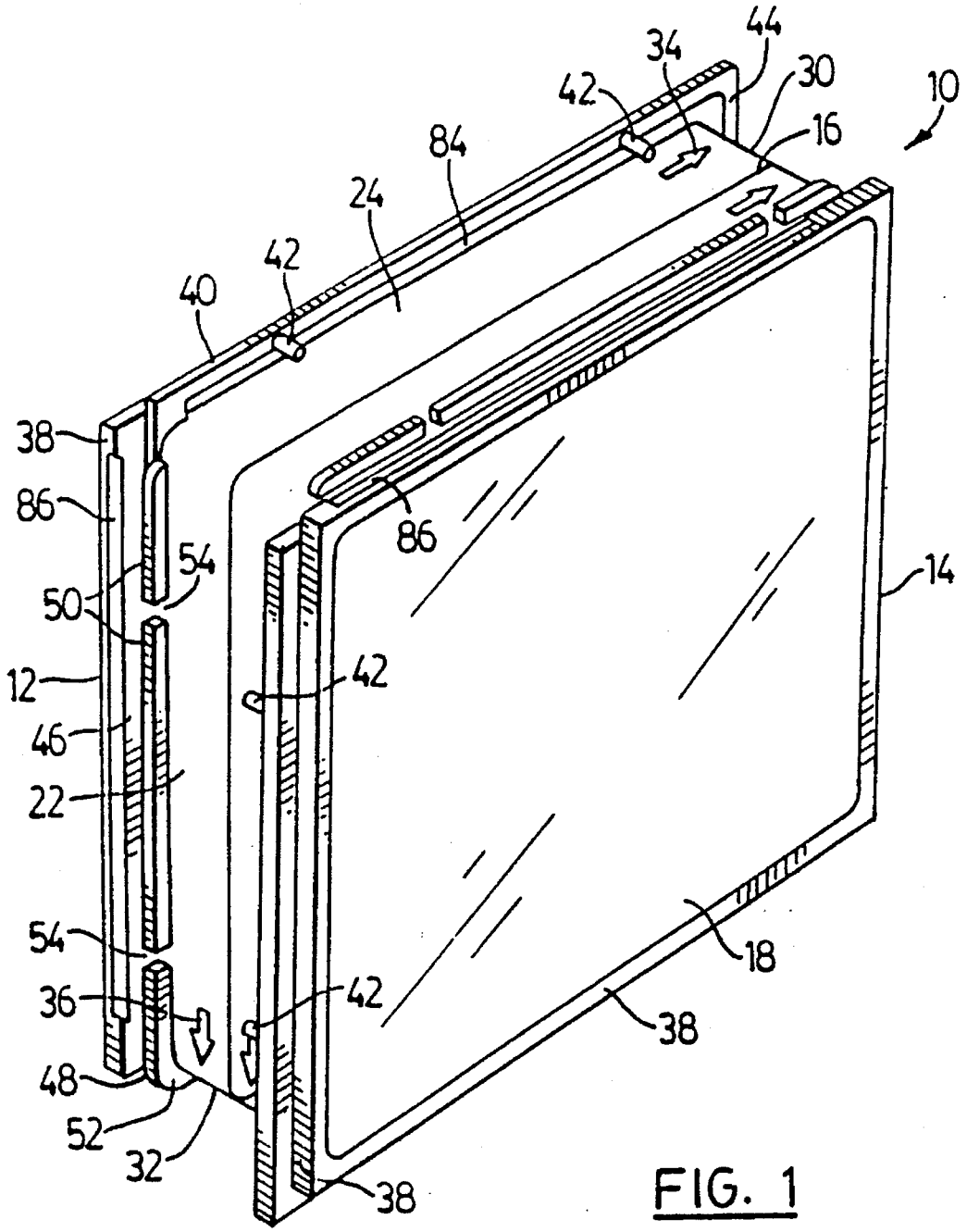
FIG. 1 is a perspective view of one embodiment of an interlocking building block made in accordance with the present invention.
Figure 2:
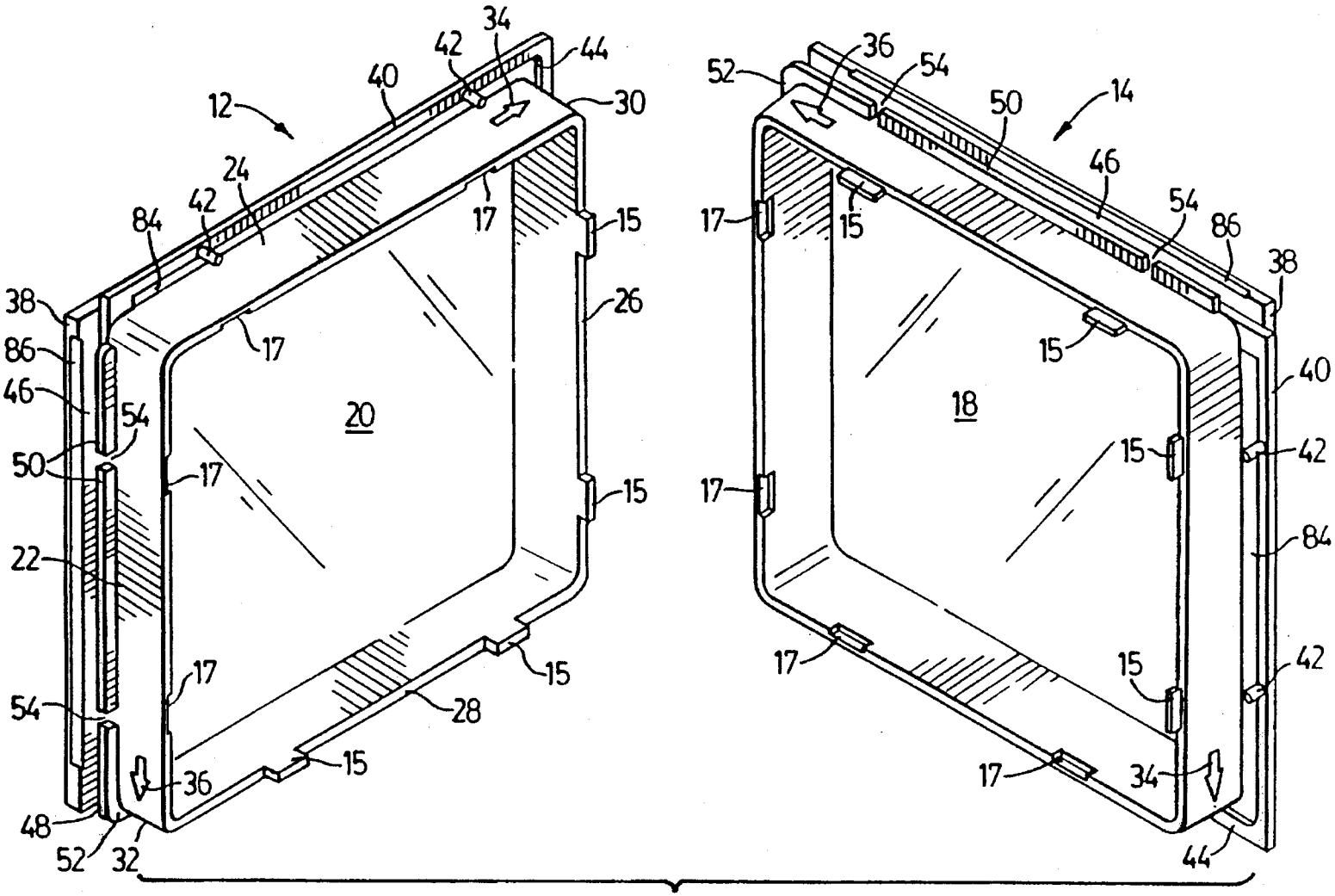
FIG. 2 is an exploded perspective view showing two halves of the block that go together to make up the block shown in FIG. 1.

Referring firstly to FIGS. 1 and 2, an interlocking building block according to the present invention is generally indicated by reference numeral 10. Block 10 is formed of two identical block halves 12 and 14 as seen best in FIG. 2, each half block 12, 14 being injection moulded out of translucent, polycarbonate, thermoplastic resin, so that the assembled block 10 resembles a conventional glass block or tile. If desired other plastics could be used for block 10 as well, such as acrylic. Block halves 12, 14 are welded together using heated platens, ultrasonic welding or other conventional heating means to provide a central seam 16 along the central or mid plane of block 10. Locating tabs 15 and mating recesses 17 are provided along the mating edges of block 10 to ensure that the halves 12, 14 go together correctly and are aligned properly during the welding process.

Block 10 is rectangular and has spaced-apart front and rear walls 18, 20 and peripheral end walls 22, 24, 26 and 28. End walls 24 and 26 are adjacent and intersect at a right angle represented by corner 30. End walls 22 and 28 are also adjacent and intersect at a right angle, as represented by corner 32. Arrows 34 are faintly moulded into end wall 24 pointing in the direction of corner 30 and arrows 36 are faintly moulded into end wall 22 to point in the direction of corner 32. The purpose of arrows 34, 36 are to aid in the assembly of a block wall using blocks 10 as will be discussed further below. Instead of faintly moulding arrows 34, 36 into end walls 24, 22, it will be appreciated that these arrows could be etched or engraved or marked on the walls in some other fashion, if desired. Alternatively, arrows 34, 36 could be omitted, because the blocks are fairly easy to assemble into a wall without the arrows, as will be described further below.

Figure 4:
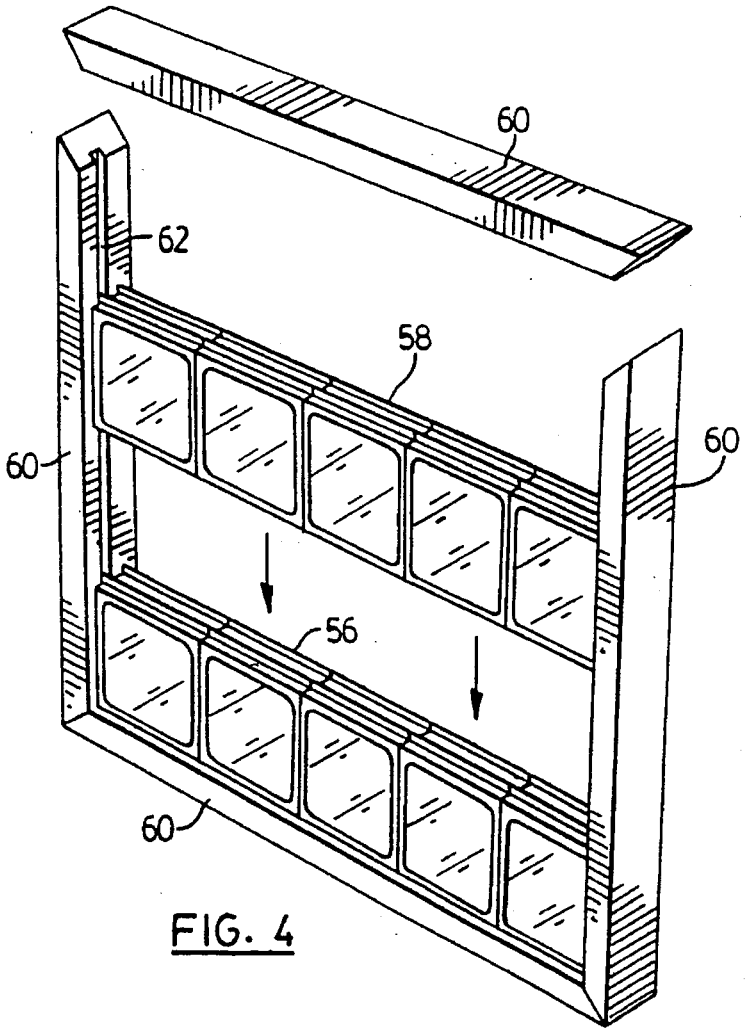
FIG. 4 is a perspective view similar to FIG. 3 but showing further stages of the assembly of a block wall made in accordance with this invention.
Figure 11:
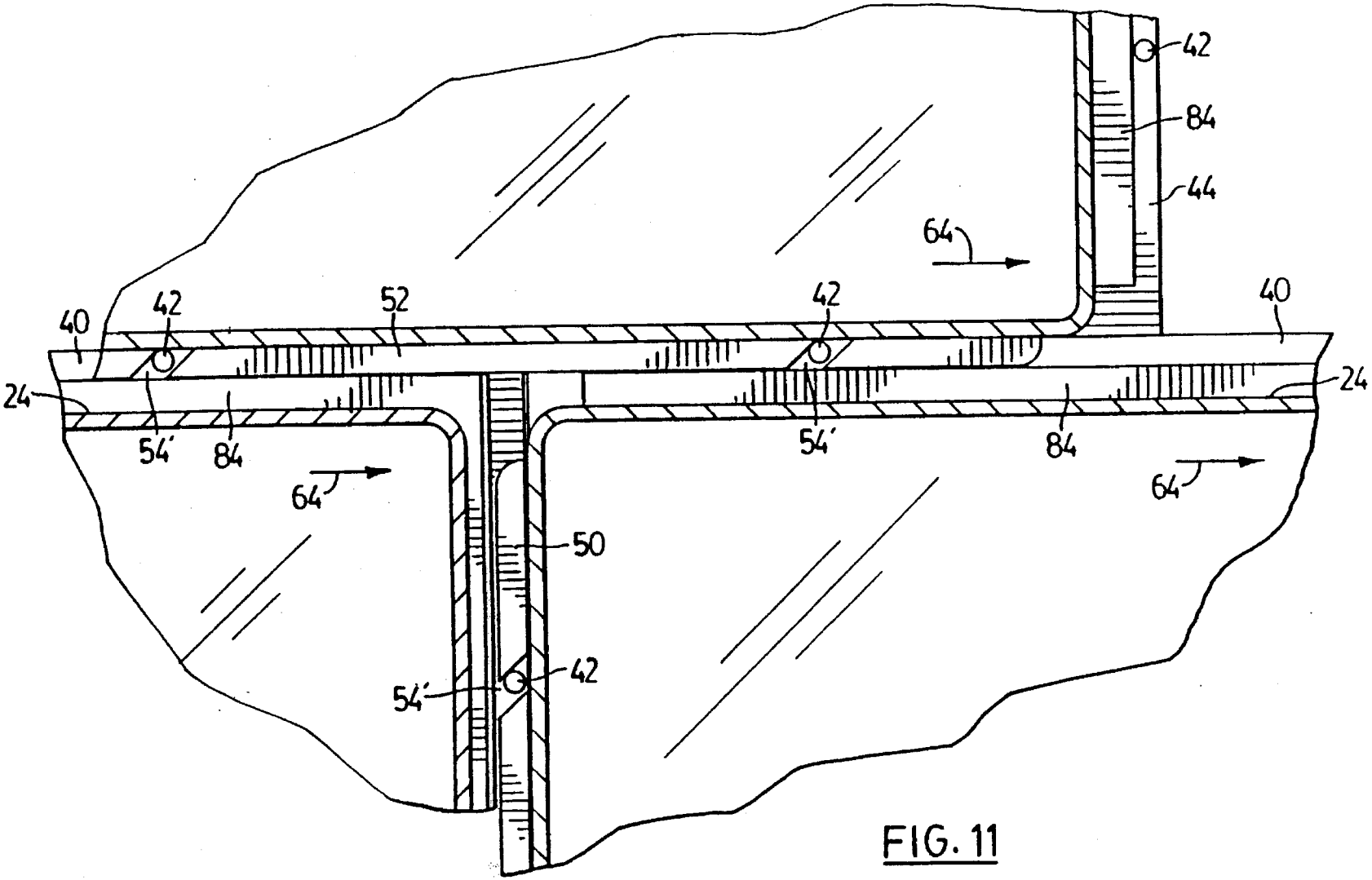
FIG. 11 is a sectional view similar to FIG. 9 showing how the blocks may be assembled in a staggered fashion.

Block 10 is connected to adjacent blocks to form a wall in a tongue and groove fashion, and the formation of these tongues and grooves will next be described. First, each block half 12, 14 is formed with an outer peripheral flange 38 which may be considered to be part of end walls 22 to 28. End wall 24 has an elongate rib 40 having spaced-apart, inwardly disposed, lateral projections 42 formed thereon. Lateral projections 42 are spaced apart about one-half the length of end walls 22 to 28 and are spaced inwardly about one-quarter of the length of the end walls, so that the blocks can be staggered or overlapped as indicated in FIG. 11 as well as being stacked in vertical or horizontal rows as indicated in FIG. 4. End wall 26 also has an elongate rib 44 located adjacent to outer flange 38 and has inwardly projecting lateral projections 42 as well. It will be appreciated that ribs 40, 44 intersect adjacent to corner 30. Lateral projections 42 form first and second interlocking means on intersecting end walls 24, 26 to engage complimentary interlocking means on adjacent blocks as described next below.

Intersecting end walls 22 and 28 have elongate grooves 46, 48 formed by outer flange 38 and inwardly spaced, parallel, inner flanges 50, 52. Inner flanges 50, 52 are formed with lateral notches or slots 54 adjacent to grooves 46, 48 and are spaced apart so that they receive the lateral projections 42 on an adjacent block as will be described further below.

As mentioned above, blocks 10 are formed from two identical block halves 12, 14. As seen best in FIG. 2, in order to form block 10, one of the block halves is rotated so that an arrow 34 is adjacent to an arrow 36 and vice versa. The block halves are then welded together as mentioned above. The assembled block thus has four peripheral end walls with two adjacent end walls having adjacent ribs on one side of the block, and the opposite two adjacent end walls having adjacent grooves on the same one side of the block. The adjacent ribs on one side of the block are parallel to and spaced from adjacent grooves on the opposite or other side of the block. Similarly, the adjacent end walls having adjacent grooves on one side of the block also have parallel, spaced-apart adjacent ribs on the opposite or other side of the block. This maximizes the number of ways in which blocks 10 can be assembled, some of which will be described below. It will be appreciated, however, that the blocks do not have to have ribs and grooves on all four end walls. It is sufficient that there be ribs and grooves on two intersecting end walls, so that the block is restrained from movement horizontally, vertically and laterally by engagement with mating blocks.

Figure 3:
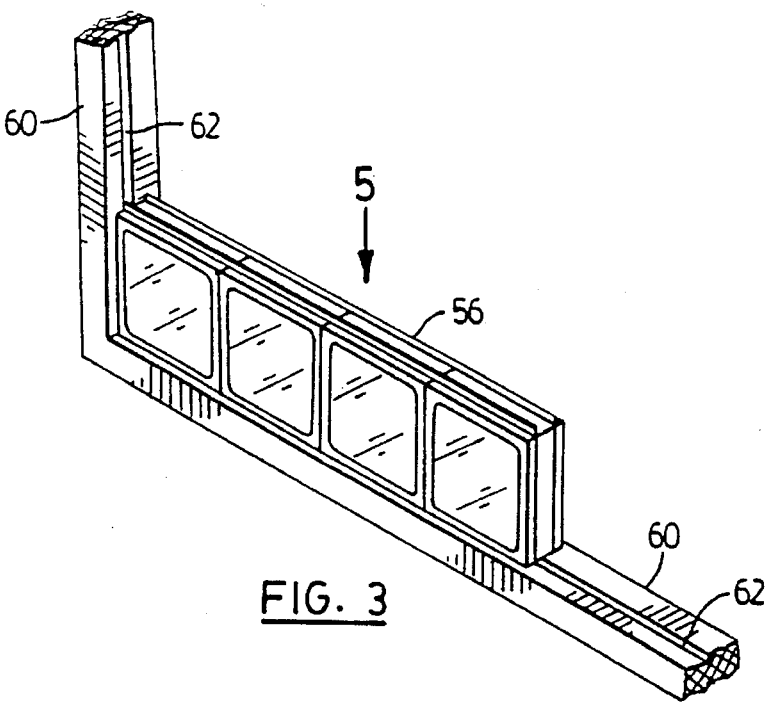
FIG. 3 is a perspective view of a section of a wall to be formed using the blocks of FIG. 1.

FIGS. 3 and 4 illustrate one method of constructing a block wall using blocks 10 wherein a first row of blocks 56 are assembled and then additional rows, such as row 58 are assembled and mounted on top of row 56. Optional frame 60 may be used to box in the wall of blocks, or other capping strips may be used as will be described further below.

Figure 5:
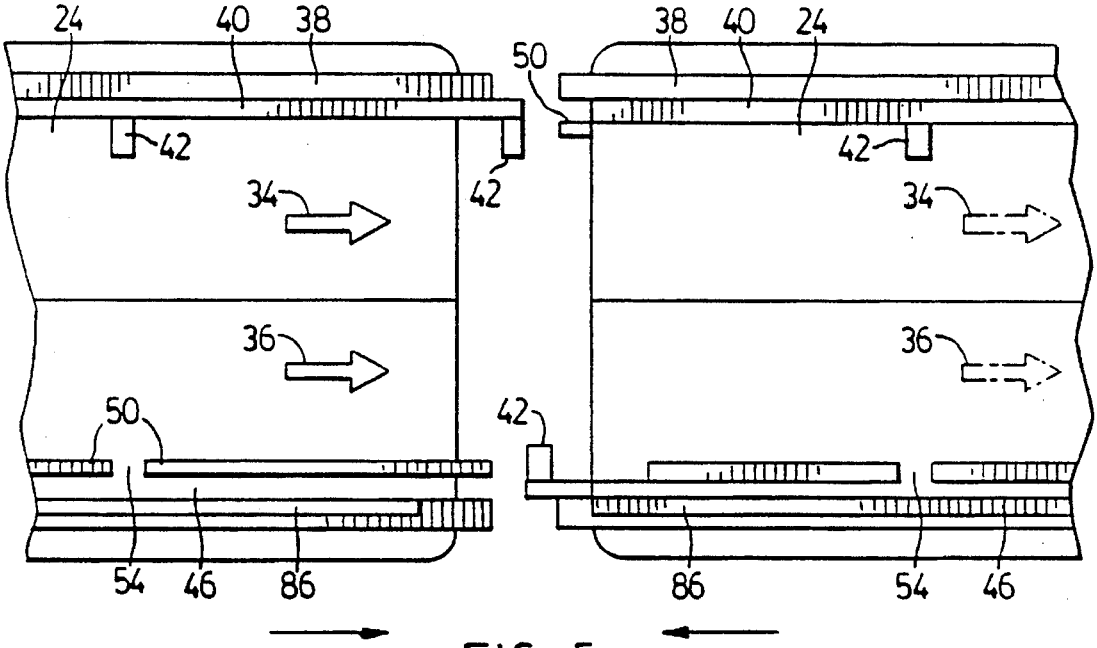
FIG. 5 is a plan view of a portion of FIG. 3 taken in the direction of arrow 5 showing two adjacent blocks about to be put together.
Figure 6:
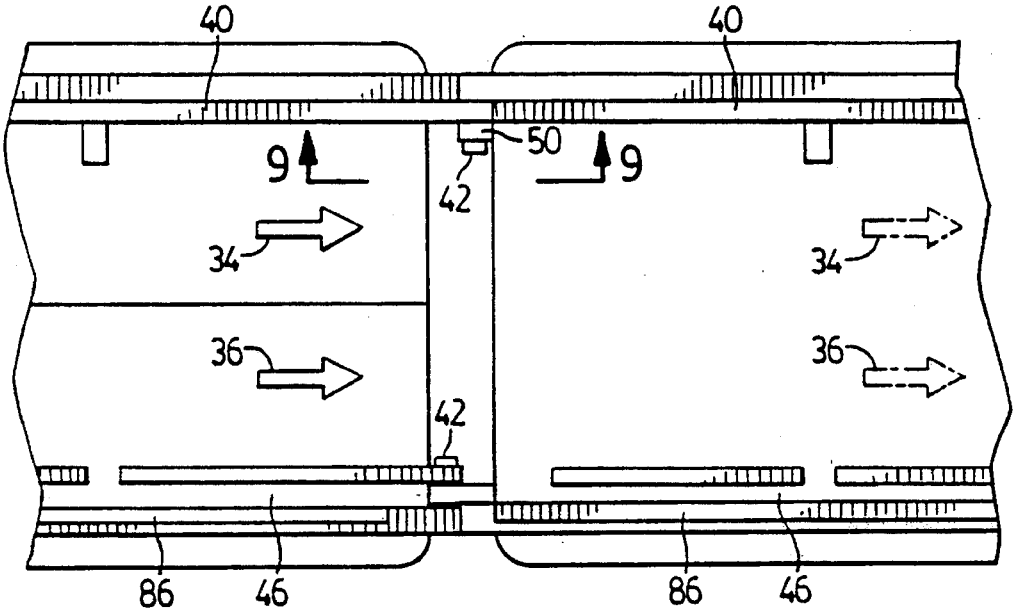
FIG. 6 is a view similar to FIG. 5 but showing the blocks after they have been put together.

FIGS. 5 and 6 show in more detail one method of assembling blocks 10 in which the blocks are aligned so that arrows 34, 36 on adjacent blocks are aligned in the same direction. Arrows 34, 36 in the right most block are shown in chain dotted lines, because they would actually appear at the far right end of end wall 24 and have been moved over in FIGS. 5 and 6 for the purposes of illustration. In the assembled configuration as shown in FIG. 6, all of the elongate ribs 40 along one side of a row of blocks are in alignment, and all of the elongate grooves 46 along the other side of the blocks are in alignment. Rows of blocks formed in this fashion can simply be stacked one on top of the other to any height desired. If a frame member is used to box in a wall of blocks as illustrated in FIGS. 3 and 4, the frame members would need a single groove 62 to accommodate the rows of ribs 40, 42 formed on one side of the wall of blocks.

Figure 7:
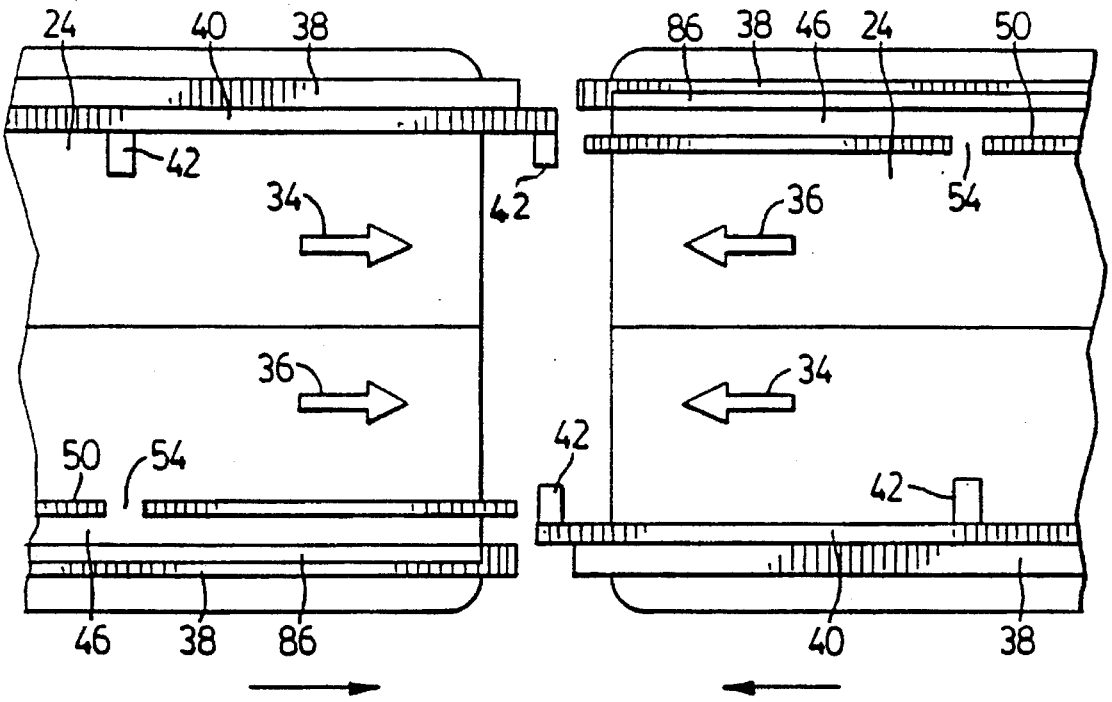
FIG. 7 is a view similar to FIG. 5, but showing another way to put the blocks together.
Figure 8:
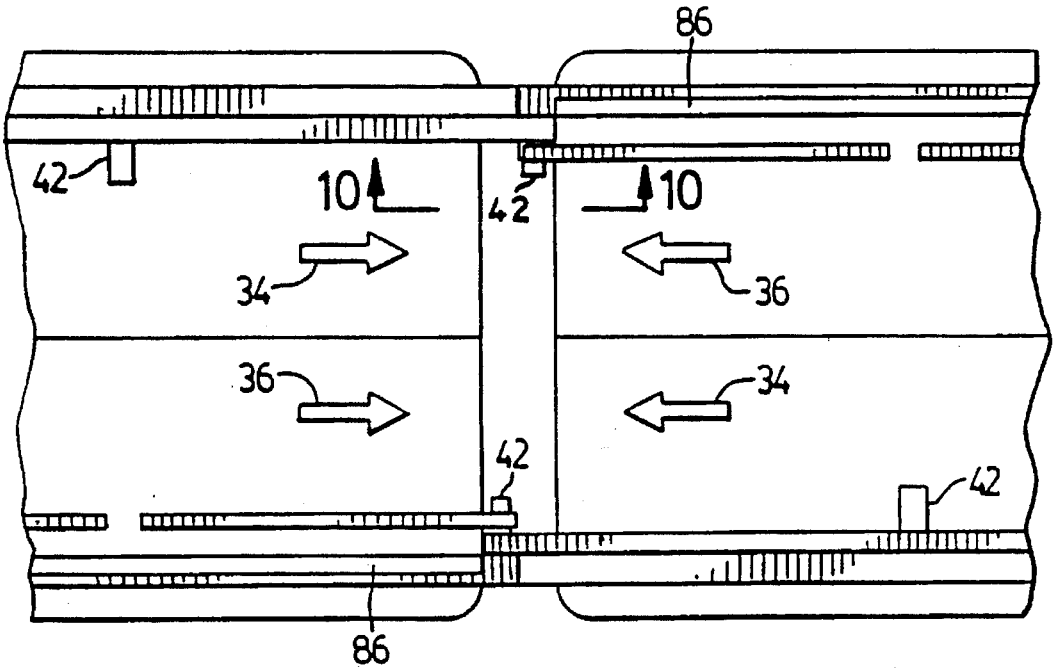
FIG. 8 is a view similar to FIG. 6 but showing the blocks assembled in accordance with FIG. 7.

FIG. 7 and 8 show another method of assembling the blocks wherein arrows 34, 36 face each other on adjacent blocks. It will be noted that in this configuration the ribs 40 alternate from side to side in a row of blocks as do grooves 46. In this configuration, a frame member such as frame 6 shown in FIGS. 3 and 4 would need two parallel grooves 62 to accommodate the ribs 40, 44 on either side of the blocks. In this configuration, however, it will be noted that lateral projections 42 appear on both sides of the blocks and the purpose of this will be discussed below.

Figure 9:
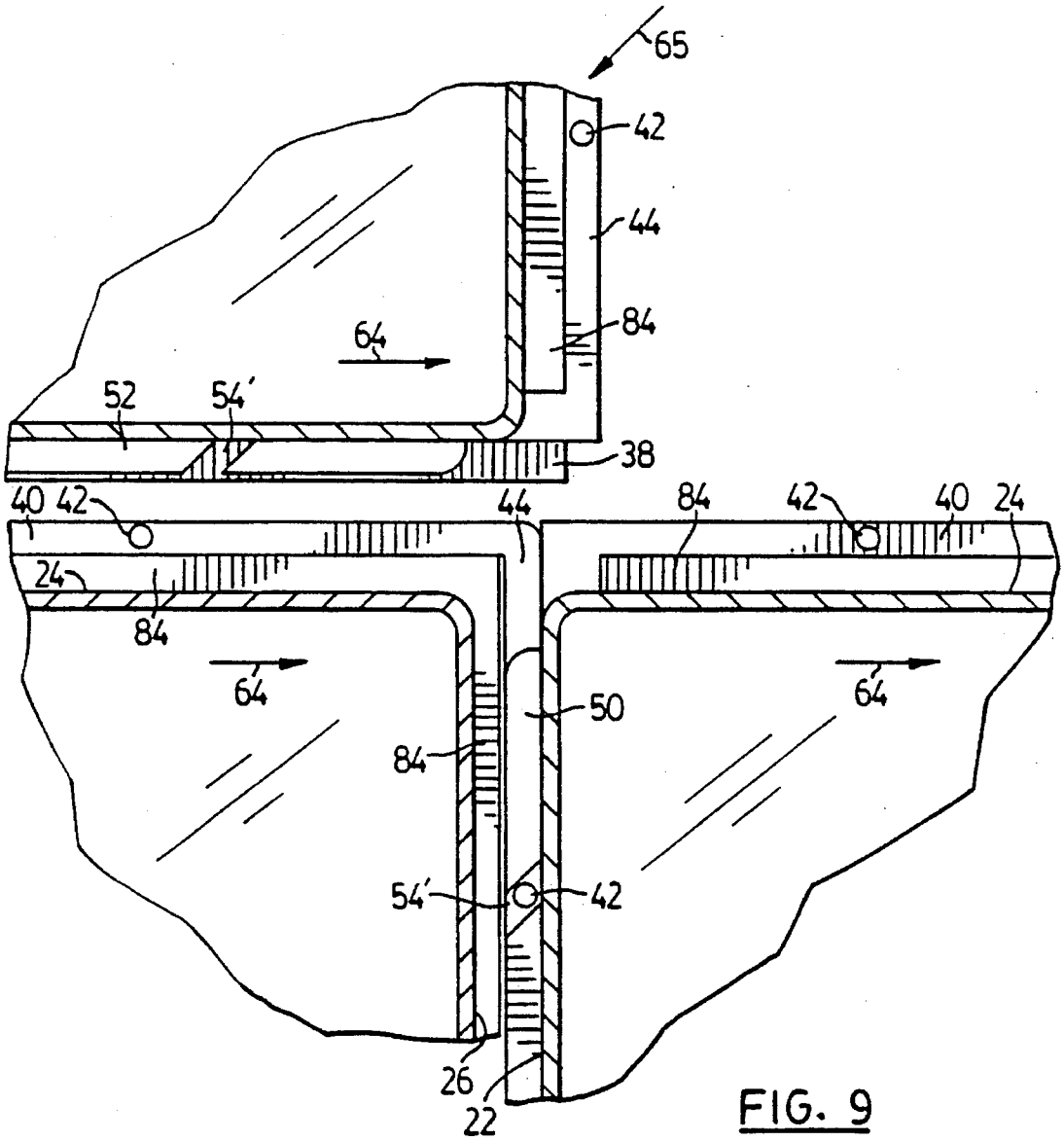
FIG. 9 is a sectional view taken along lines 9—9 of FIG. 6 and showing a third block about to be assembled to the two blocks shown in FIG. 6.

FIG. 9 shows how a second row of blocks is attached to a first assembled row of blocks as illustrated in FIG. 6. Arrows 64 in FIG. 9 indicate the direction of arrows 34, 36 which are not visible in FIG. 9. FIG. 9 also shows an angled slot 54' which is preferred over slots 54 in the embodiment shown in FIGS. 1 and 2. The angled slots 54 permit an upper block to be attached or connected to a row of lower blocks by moving the block downward and to the left as indicated in FIG. 9, rather than straight down as would be the case for the FIG. 1 embodiment. The advantage of this is that after three blocks have been assembled as indicated by arrow 65 in FIG. 9, a fourth block can be added in the vacant quadrant by sliding the block downwardly and to the left so that slots 54' accommodate lateral projections 42 on the two existing mating blocks. This type of slot 54' also prevents the vertical or horizontal separation of adjacent blocks to increase the strength of an assembled wall.

Figure 10:
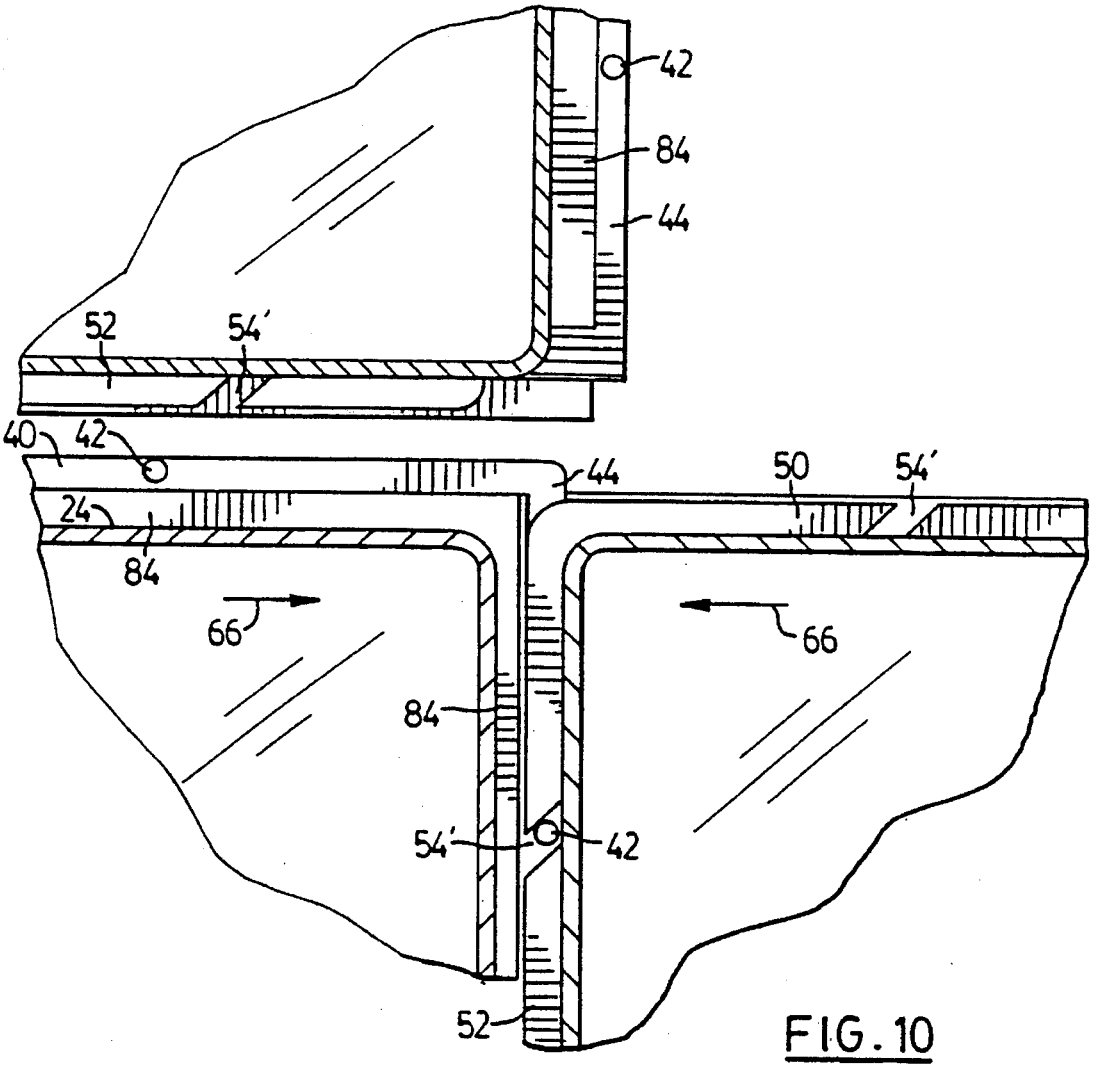
FIG. 10 is a sectional view taken along lines 10—10 of FIG. 8 and showing another block about to be assembled to the blocks shown in FIG. 8.

FIG. 10 is a view similar to FIG. 9, but illustrates what happens when the blocks are put together with arrows 34, 36 facing each other as indicated by arrows 66.

FIG. 11 is similar to FIG. 9, but illustrates how an upper block can overlap two lower blocks to produce a wall with a brick-work appearance.

Figure 12:
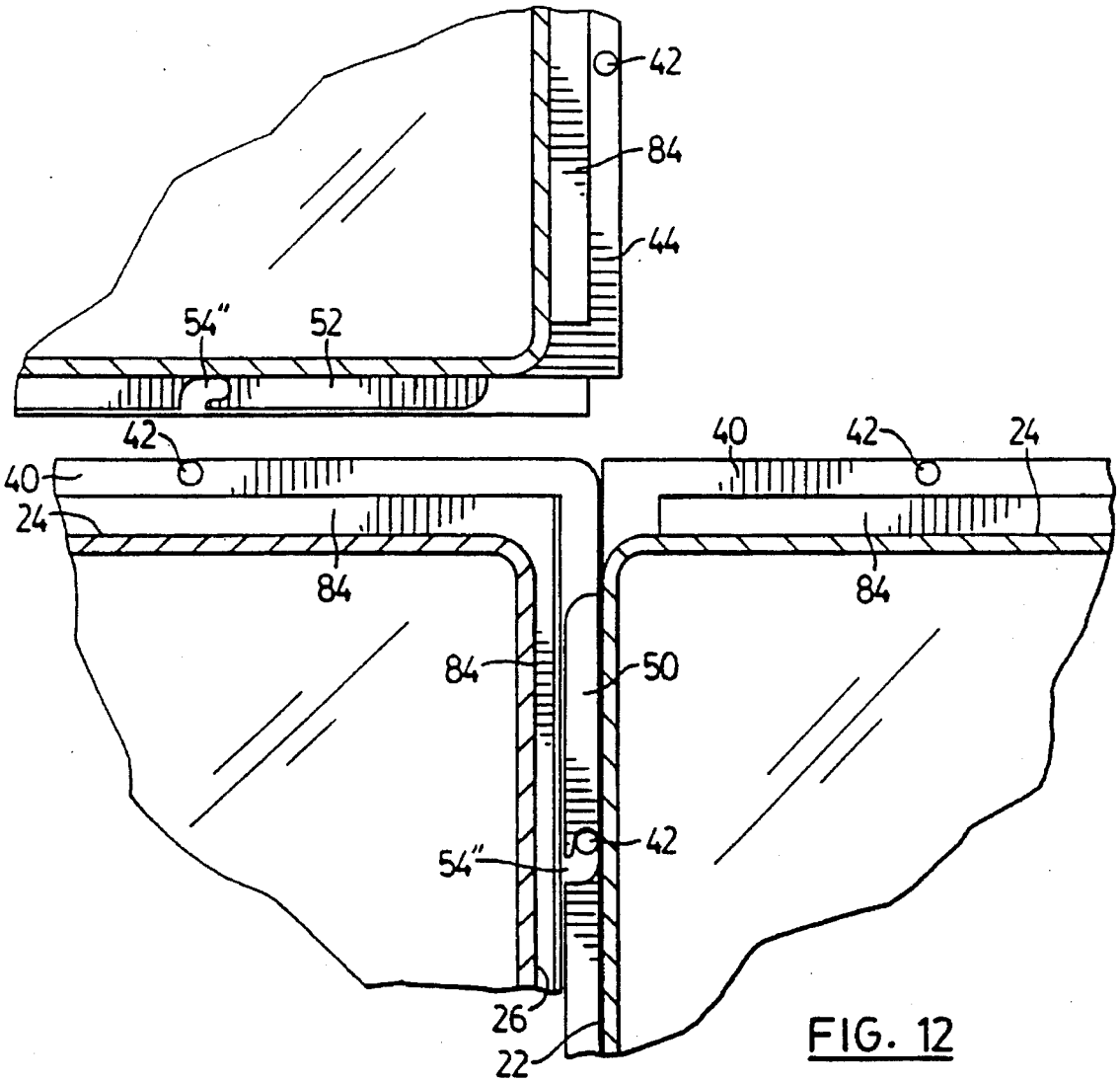
FIG. 12 is a sectional view similar to FIG. 9 but showing a hooked notch as part of the block interlocking means.

FIG. 12 is similar to FIG. 9, but shows another form of hooked notch or slot 54". Slot 54" functions in a manner similar to slots 54', but requires mating blocks to be moved first toward each other and then slid parallel to each other to interlock them.

Figure 13:
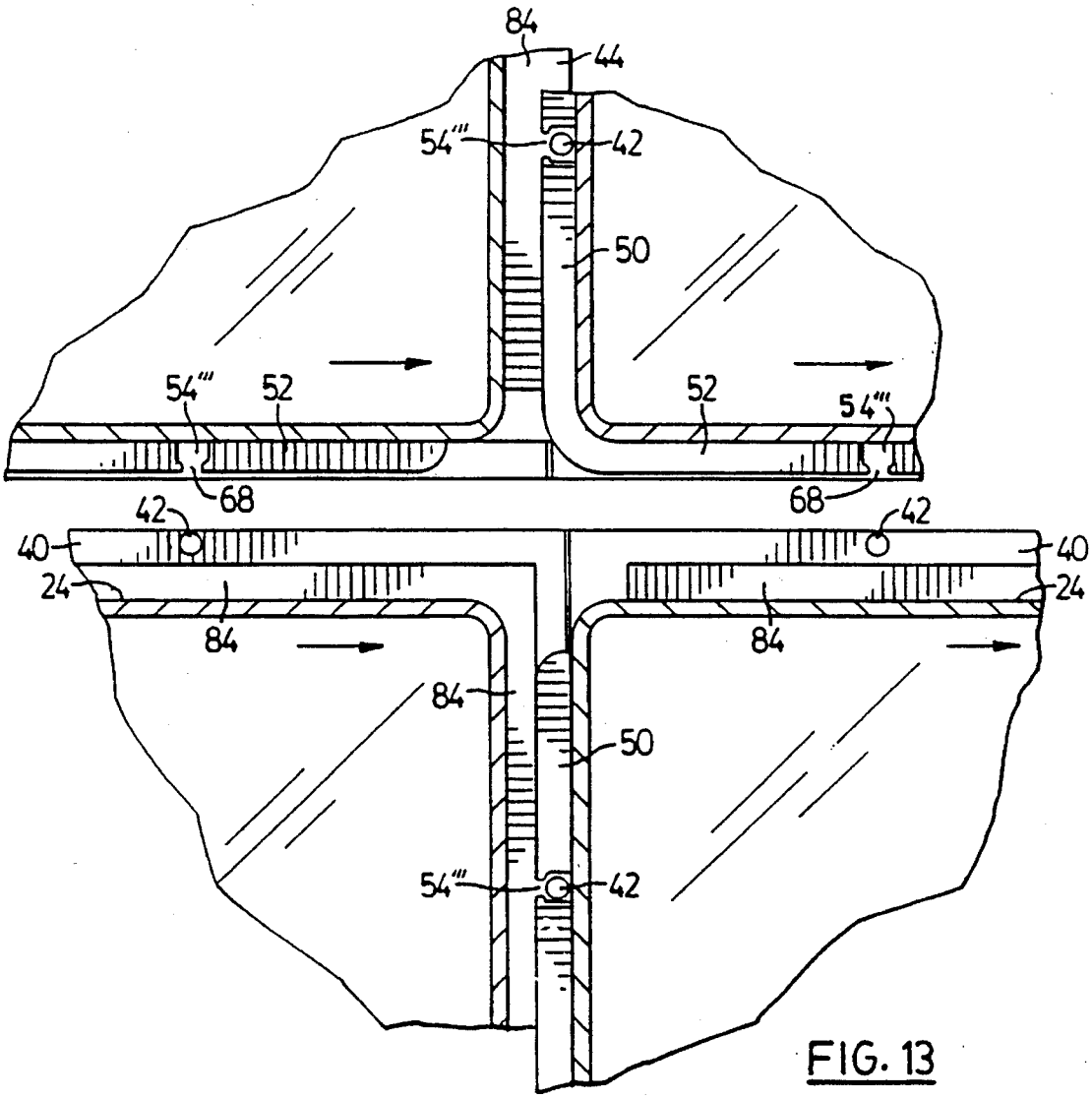
FIG. 13 is a view similar to FIG. 9 but showing yet another form of notch forming part of the block interlocking means.

FIG. 13 shows another type of slot or notch 54''' having a restricted throat 68, so that lateral projections 42 snap into notches or slots 54''', thus also resisting horizontal and vertical separation of adjacent blocks and increasing the strength of an assembled wall.

Figure 14:
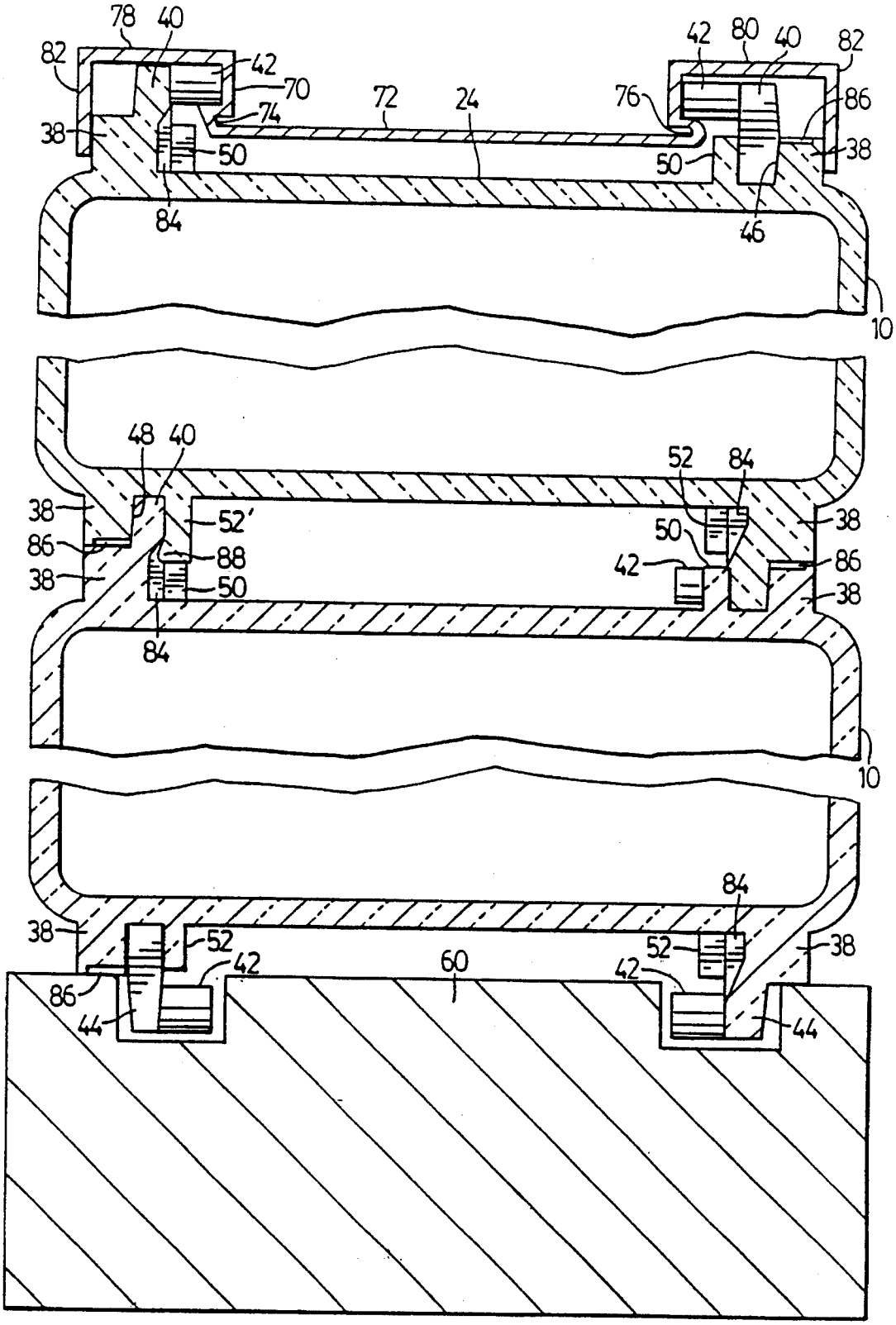
FIG. 14 is a vertical sectional view taken through a typical wall where the blocks are assembled in accordance with FIG. 7 and 8, but showing some further modifications.

FIG. 14 is an enlarged cross-sectional view of a typical wall formed by blocks assembled where arrows 34, 36 face each other as indicated in FIGS. 7, 8 and 10, but showing some additional modifications. First, an elongate capping strip 70 is shown mounted on the top block 10 to finish off a top of a wall in place of a framing member 60 as illustrated in the bottom of FIG. 14. Capping strip 70 has a central portion 72 which extends between rib 40 and groove 46 in end wall 24. Central portion 72 has peripheral side flanges 74, 76 which are located under lateral projections 42. For the purposes of clarification, the rib 40 and lateral projection 42 shown in the upper right hand corner of FIG. 14 belong to a block 10 mounted in the wall immediately behind the block 10 shown in cross-section. Capping strip 70 also has outwardly disposed side members 78, 80 which extend outwardly, above and cover the ribs 40 in lateral projections 42 to hide them from view. Side members 78, 80 also have downwardly extending flanges 82 that overlap the block outer flanges 38. Capping strip 72 is formed of a somewhat resilient material such as plastic or extruded or roll formed metal so that it can be snapped in place under lateral projections 42. It will be appreciated that the configuration of the side flanges 74, 76 can be interchanged or both made the same as desired.

FIG. 14 also best illustrates the fact that ribs 40 have an inwardly facing elongate undercut 84. Also, the end surfaces of outer flanges 38 can be formed with recesses 86 to provide a space for sealant between mating outer flanges 38 where it is desired to ensure that a wall formed of blocks 10 is water tight. Another modification illustrated in FIG. 14 is that inner flanges 52' which form one wall of grooves 46, 48 can be extended downwardly and formed with an outwardly disposed elongate lateral ridge 88 to snap into undercuts 84 to help prevent separation of adjacent blocks 10. Yet another modification best illustrated in FIG. 14 is that ribs 40, 44 and grooves 46, 48 have a five degree taper to provide a friction fit between the ribs and grooves when respective adjacent blocks are put together. These tapers are themselves interlocking means to frictionally engage and prevent sliding movement of one block relative to another. Only one extended inner flange 52' is shown in FIG. 14, but this construction could be applied to all of the inner flanges 50, 52 if desired.

Figure 15:
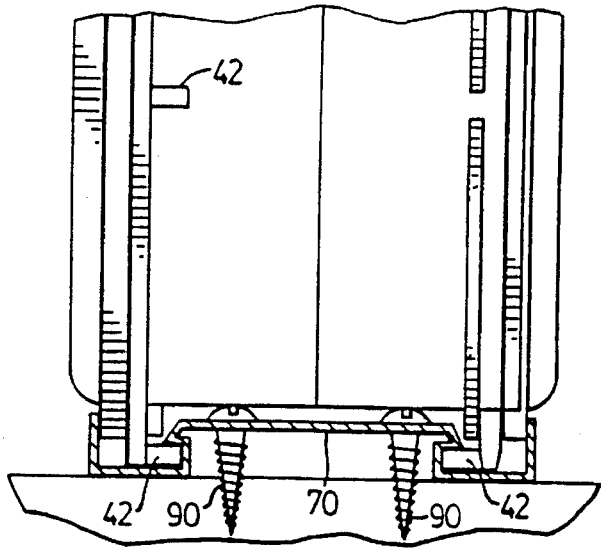
FIG. 15 is an end elevational view of a portion of a block showing a capping strip used as a base or anchoring member for a wall.

FIG. 15 illustrates another use for capping strip 70 in that it can be mounted to another surface such as by screws 90 and thus used to anchor a wall formed by blocks 10 to a floor or another wall or other supporting surface, as desired.

Figure 16:
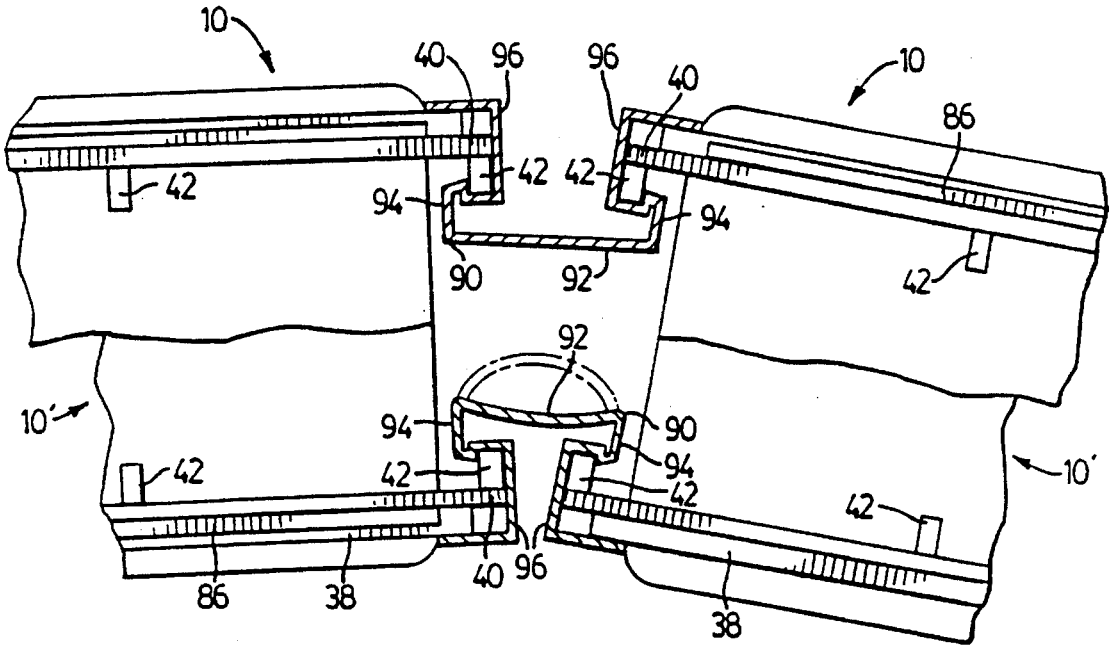
FIG. 16 is a plan view showing two courses of blocks, one on top of the other, the blocks being separated and joined by hinge clips to provide a curved wall structure.

FIG. 16 shows the use of a hinge clip 92, where it is desired to use blocks 10 in a circular configuration to form a rounded wall. Hinge clips 90 have a central resilient member 92 having transversely disposed, spaced-apart side flanges 94 for engaging and holding together lateral projections 42 on adjacent spaced-apart blocks 10. Hinge clips 90 also have outer peripheral, U-shaped side edge portions 96 which enclose ribs 40 and flanges 38 to retain the clip side flanges 94 in place.

FIG. 16 actually shows two rows of blocks; a lower row of blocks 10 and an upper row of blocks 10' mounted on blocks 10. In each row, the blocks are arranged so that flanges 40 have opposed lateral projections 42. Each successive row would alternate, because in any one row, opposed lateral projections 42 would be on one side of the blocks and opposed grooves 46 or 48 would be on the other side of the blocks. To assemble the hinge clips to blocks 10, 10', one side of the blocks would be separated as indicated in the upper half of FIG. 16, the hinge clips would be snapped into place or slid longitudinally down over lateral projections 42 as desired. The blocks would then be rotated to compress the hinge clip as indicated in the lower half of FIG. 16 and the second hinge clip 90 would be snapped or slid into the now wider gap between the ribs 40 as indicated in the upper half of FIG. 16.

Figure 17:
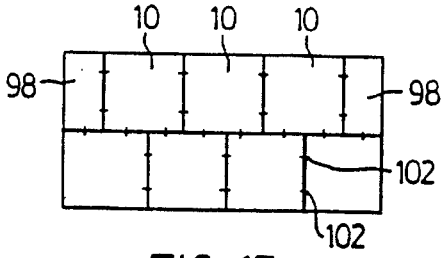
FIGS. 17 to 22 are diagrammatic views showing different shapes of blocks that could be used employing the interlocking means of the present invention.
Figure 18:
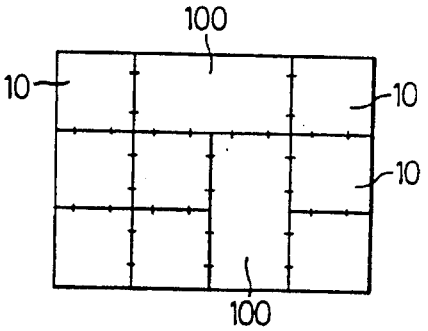
Figure 19:
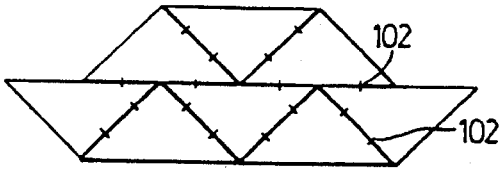
Figure 20:
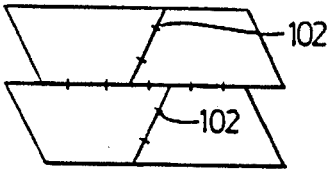
Figure 21:
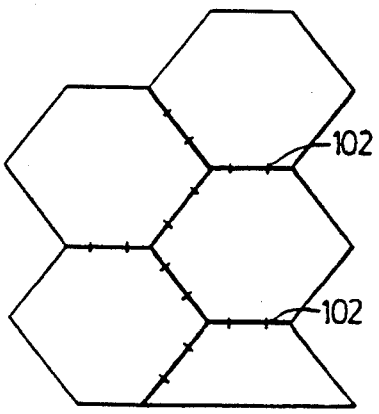
Figure 22:
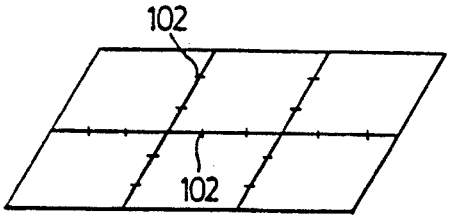

Finally, FIGS. 17 to 22 illustrate various shapes of blocks that could be made according to the present invention. In FIG. 17, half blocks 98 could be used with regular blocks 10. FIG. 18 shows the use of double blocks 100 with regular blocks 10. FIG. 19 shows triangular blocks. FIG. 20 shows trapezoidal blocks. FIG. 21 shows hexagonal or other polygonal blocks and FIG. 22 shows parallelogram blocks. In all cases, the interlocking means 102 would be similar to the tongue and groove/lateral projection and slot structures described above.

From the above, it will be seen that the interlocking block of the present invention provides a very strong wall structure with maximum flexibility in assembly and high strength to prevent separation of the blocks under load.

What is claimed is:

1. An interlocking building block comprising:

a block having spaced-apart front and rear walls and peripheral end walls, the block being shaped such that a plurality of such blocks may be arranged in a contiguous manner with respective end walls touching to form a wall, there being at least two adjacent peripheral end walls on each block intersecting at an angle;

each of said intersecting end walls having an elongate rib and means defining a parallel elongate groove spaced therefrom and adapted to mate with a corresponding respective elongate groove and rib on an adjacent block;

a first interlocking means formed on one of the rib and the groove in one of said intersecting end Walls adapted to engage a complementary interlocking means on a first adjacent block to prevent longitudinal sliding movement of the rib in the groove with respect to said first adjacent block;

a second interlocking means formed on one of the rib and the groove in the other of said intersecting end walls adapted to engage a complementary interlocking means on a second adjacent block to prevent longitudinal sliding movement of the rib in the groove with respect to said second adjacent block; and the first and second interlocking means being one of a lateral projection formed on the rib and means defining a lateral slot adjacent to the groove and located to receive a lateral projection formed on a rib of an adjacent block.

2. A block as claimed in claim 1 wherein the block is rectangular having four peripheral end walls, two adjacent end walls having adjacent ribs on one side of the block, and the opposite two adjacent end walls having adjacent grooves on said one side of the block.

3. A wall formed by a plurality of blocks with each block being that defined in claim 1, said blocks being arranged in a contiguous manner with respective end walls touching to form said wall; the elongate ribs and grooves on each end wall mating with corresponding grooves and ribs on the respective touching wall; and the lateral projections on each rib being received in the slots in the respective touching end wall.

4. An interlocking building block comprising:

a block having spaced-apart front and rear walls and peripheral end walls, the block being shaped such that a plurality of such blocks may be arranged in a contiguous manner with respective end walls touching to form a wall, there being at least two adjacent peripheral end walls on each block intersecting at an angle;

each of said intersecting end walls having an elongate rib and means defining a parallel elongate groove spaced therefrom and adapted to mate with a corresponding respective elongate groove and rib on an adjacent block;

a first interlocking means formed on both the rib and the groove of the first intersecting end wall adapted to engage complementary interlocking means on a first adjacent block to prevent longitudinal sliding movement of the ribs in the grooves in said block and said first adjacent block;

a second interlocking means formed on both the rib and the groove of the second intersecting end wall adapted to engage complementary interlocking means on a second adjacent block to prevent longitudinal sliding movement of the ribs in the grooves in said block and said second adjacent block and the first and second interlocking means each including a lateral projection formed on the rib and means defining a lateral slot adjacent to the groove and located to receive a lateral projection formed on a rib of an adjacent block.

5. A block as claimed in claim 4 wherein the grooves are formed by a pair of elongate, parallel, spaced-apart flanges, the slots being formed by providing notches in one of said flanges.

6. A block as claimed in claim 5 wherein said notches are disposed at an angle in the flanges.

7. A block as claimed in claim 5 wherein the notches are formed with a restricted throat, so that the lateral projections snap into the notches, the throats resisting the removal of the projections from the notches.

* * * * *